US008884856B2

(12) United States Patent
Lebrun et al.

(10) Patent No.: US 8,884,856 B2
(45) Date of Patent: Nov. 11, 2014

(54) SEQUENTIAL COLOUR MATRIX LIQUID CRYSTAL DISPLAY

(75) Inventors: Hugues Lebrun, Coublevie (FR); Thierry Kretz, Saint Jean de Moirans (FR)

(73) Assignee: Thales, Neuilly sur Seine (FR)

( * ) Notice: Subject to any disclaimer, the term of this patent is extended or adjusted under 35 U.S.C. 154(b) by 728 days.

(21) Appl. No.: 12/096,470

(22) PCT Filed: Dec. 6, 2006

(86) PCT No.: PCT/EP2006/069369

§ 371 (c)(1),
(2), (4) Date: Sep. 30, 2008

(87) PCT Pub. No.: WO2007/065908

PCT Pub. Date: Jun. 14, 2007

(65) Prior Publication Data

US 2009/0146937 A1 Jun. 11, 2009

(30) Foreign Application Priority Data

Dec. 7, 2005 (FR) ..... 05 12412

(51) Int. Cl.
*G09G 3/36* (2006.01)

(52) U.S. Cl.
CPC ..... *G09G 3/3696* (2013.01); *G09G 2320/0233* (2013.01); *G09G 3/3688* (2013.01); *G09G 2310/0235* (2013.01); *G09G 2310/027* (2013.01)
USPC ..... 345/88; 345/87; 345/104

(58) Field of Classification Search
CPC ..... G09G 3/3688; G09G 3/3696; G09G 2310/0235; G09G 2310/027; G09G 2320/0233
USPC ..... 345/38, 50–54, 87–104, 690–696
See application file for complete search history.

(56) References Cited

U.S. PATENT DOCUMENTS 6,064,713 A 5/2000 Lebrun et al.
6,359,608 B1 3/2002 Lebrun et al.

(Continued)

FOREIGN PATENT DOCUMENTS

EP 0 478 186 4/1992
EP 1 251 481 A2 10/2002

(Continued)

OTHER PUBLICATIONS

Japanese Office Action issued Feb. 19, 2013 in Patent Application No. 2008-543824 with English Translation.

(Continued)

*Primary Examiner* — Amare Mengistu
*Assistant Examiner* — Vinh Lam
(74) *Attorney, Agent, or Firm* — Oblon, Spivak, McClelland, Maier & Neustadt, L.L.P.

(57) ABSTRACT

A video system including a sequential color liquid crystal display with a panel of pixels arranged in rows and columns, including a mechanism that controls unit brightness levels on each pixel in the panel called grey levels, each grey level corresponding to a video information received at the input. The grey level controlled on a pixel is achieved with an analog voltage that varies monotonously depending on the row associated with the pixel and/or a color to be displayed.

10 Claims, 3 Drawing Sheets

(56) References Cited

U.S. PATENT DOCUMENTS

| | | | | |
|---|---|---|---|---|
| 6,611,311 | B1 | 8/2003 | Kretz et al. | |
| 6,879,310 | B2 * | 4/2005 | Nose | 345/88 |
| 2001/0048418 | A1 * | 12/2001 | Kasai et al. | 345/87 |
| 2002/0145581 | A1 * | 10/2002 | Kudo et al. | 345/89 |
| 2003/0128218 | A1 * | 7/2003 | Struyk | 345/581 |
| 2003/0160751 | A1 * | 8/2003 | Kudo et al. | 345/89 |
| 2003/0218591 | A1 | 11/2003 | Shen et al. | |
| 2004/0140985 | A1 | 7/2004 | Liaw | |
| 2004/0196236 | A1 * | 10/2004 | Kudo et al. | 345/89 |
| 2005/0116888 | A1 | 6/2005 | Kim et al. | |
| 2006/0145982 | A1 * | 7/2006 | Tseng | 345/89 |
| 2006/0152534 | A1 * | 7/2006 | Chang et al. | 345/690 |
| 2006/0209000 | A1 * | 9/2006 | Sumiyoshi et al. | 345/102 |
| 2007/0018921 | A1 * | 1/2007 | Yoshihara et al. | 345/88 |
| 2007/0085793 | A1 * | 4/2007 | Kudo et al. | 345/89 |
| 2007/0252780 | A1 | 11/2007 | Lebrun | |
| 2008/0297465 | A1 * | 12/2008 | Kim et al. | 345/102 |
| 2009/0153462 | A1 * | 6/2009 | Kamada et al. | 345/102 |
| 2010/0149084 | A1 * | 6/2010 | Chida | 345/102 |

FOREIGN PATENT DOCUMENTS

| | | | |
|---|---|---|---|
| JP | 2001-255508 | A | 9/2001 |
| JP | 2003-29716 | A | 1/2003 |
| JP | 2003-108083 | A | 4/2003 |
| JP | 2004-537763 | A | 12/2004 |
| JP | 2005-122148 | A | 5/2005 |
| JP | 2005-208600 | A | 8/2005 |
| JP | 2007-538268 | | 12/2007 |
| TW | 582000 | B | 4/2004 |
| WO | 2004 111985 | | 12/2004 |

OTHER PUBLICATIONS

Combined Taiwanese Office Action and Search Report issued Feb. 4, 2013 in Patent Application No. 095145702 with English Translation.

Japanese Office Action mailed Dec. 13, 2011 in Japanese Patent Application No. 2008-543824 (with English-language Translation).

* cited by examiner

SEQUENTIAL COLOUR MATRIX LIQUID CRYSTAL DISPLAY

FIELD OF THE INVENTION

This invention relates to an active matrix liquid crystal display of the sequential colour type.

One advantage of sequential colour type displays is the possibility of creating colour display systems for direct view screens without coloured filters, in other words without any colour information attached to each image point or pixel. Each pixel is then colourless and a light box is used to illuminate the display successively in the three primary colours. The invention is particularly applicable to the direct view screens market; from cell phone screens to large size screens for television.

DISCUSSION OF THE BACKGROUND

The invention is particularly applicable to displays for which pixels are controlled analogically. Unit brightness levels called grey levels, corresponding to a received video signal, are achieved by applying corresponding analogue voltage levels onto pixel columns, defined by a grey scale. To display a given grey level, the active element of a pixel is activated for one row period to transfer the corresponding analogue voltage level onto the pixel capacitance. The liquid crystal is then oriented in a direction that depends on the applied analogue value. Input light bias passing through this liquid crystal is then modified and analysed by a polariser.

The display performance depends particularly on the brightness that depends on the pixel illumination time. This illumination time depends on the addressing time necessary to transfer analogue voltage levels onto each pixel in a row of the matrix, and the liquid crystal stabilization time that depends on the previous analogue voltage level and the current analogue voltage level.

These constraints are accentuated in the case of a display addressed in sequential colour mode. Each frame comprises several coloured sub-frames, with one for each primary colour. Thus, there are usually three coloured sub-frames per frame. Thus, all pixels in the matrix have to be addressed at least three times during one frame period, to display the video information corresponding to each primary colour.

In some liquid crystal displays of the sequential colour type, the colour display frequency is increased to solve the well known colour break-up problem particularly due to the liquid crystal stabilisation time. Thus for example, there are two coloured sub-frames per primary colour in each video frame. The upper limit of the display addressing time is fixed by the duration of the video frame. Doubling the video frequency halves the duration of the video frame, which causes problems. In particular, the pixels of the last rows in the panel may not have enough time to reach their new video set value. If the previous addressing phase was for a red sub-frame, then there may be some data corresponding to the previous red sub-frame at the bottom of the panel in the new sub-frame, for example the green sub-frame.

In these different displays, the response time of the liquid crystal is a very strict constraint. This response time depends on the analogue voltage level memorised during the previous sub-frame and the analogue voltage level to be charged during the new sub-frame. In this case, the rows are scanned very quickly. For example, there are 3 milliseconds per coloured sub-frame to scan all rows. The liquid crystal switching time is of the order of 1 millisecond. Thus, in practice the first row addressed in the sub-frame has from 1 to 2 milliseconds to switch from the video level of the previous sub-frame to the video level of the current sub-frame, while the last row has hardly 1 millisecond. Depending on the previous video level and the current level, the changeover times vary and the time available for the pixels in the last rows in the frame may be insufficient to allow these pixels to converge towards their new target level.

Taking the example of a TN (Twisted Nematic) type liquid crystal display, the changeover time for the liquid crystal to change from one grey level to another is much greater than the changeover time to change from the black level to the white level, or from the white level to a grey level. The black level is the liquid crystal mode in which the potential difference between the pixel and the counter electrode is maximum. The white level is the liquid crystal mode in which the potential difference between the pixel and the counter electrode is minimum. Light greys correspond to an applied potential difference similar to the value applied to obtain white, while dark greys correspond to a potential difference similar to that applied to obtain black. The changeover time to change from the white level to a light grey level may be one and a half times longer than the changeover time to change from the black level to this same light grey level. The changeover time from a light grey level to the black level is very short. In one example with TN type liquid crystals, the following changeover times were measured: 0.2 milliseconds to change from white to black; 1 millisecond to change from black to white; 3.25 milliseconds in the worst case measured between two grey levels.

SUMMARY OF THE INVENTION

In the invention, an attempt is made to improve the performances of a liquid crystal display, particularly so that several coloured sub-frames can be used per primary colour in each video frame, so as to reduce the stroboscopic effect due to the light box switching on and switching off frequency, while maintaining a good image quality.

One technical solution on which the invention is based is to make grey levels with an analogue voltage that varies monotonously depending on the row associated with the pixel and/or a colour to be displayed.

Therefore, the invention relates to a video system comprising a liquid crystal sequential colour display with a panel of pixels arranged in rows and columns including means of controlling unit brightness levels on each pixel in the panel called grey levels, each grey level corresponding to a video information received at the input, characterised in that the grey level controlled on one pixel is achieved with an analogue voltage that varies monotonously depending on the row associated with the pixel and a colour to be displayed.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention.

Accordingly, the drawings and description thereof are to be regarded as illustrative in nature, and not as restrictive.

DESCRIPTION OF THE PREFERRED EMBODIMENTS

Figure 1:
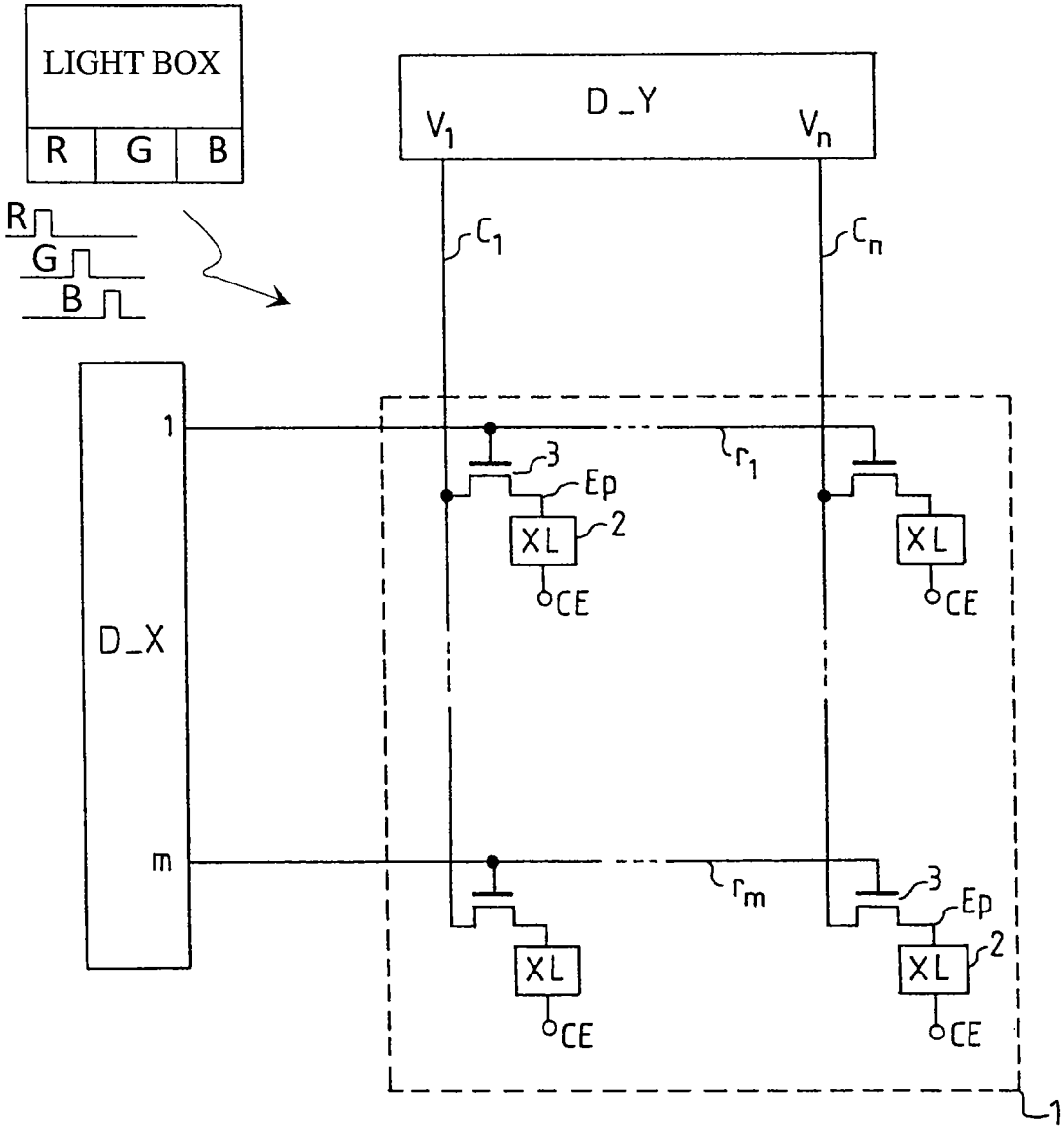
FIG. 1 illustrates an LCD display panel according to the state of the art.

FIG. 1 shows a block diagram of an LCD display with an active matrix panel 1. It comprises a first substrate supporting transistors and pixel electrodes, a second substrate that may or may not comprise coloured filters, and a counter-electrode CE common to all pixels in the panel, that may or may not be placed on the coloured filters. The two substrates are approximately parallel at a spacing from each other, with liquid crystal in the space between the two substrates between the counter-electrode and the active matrix. The panel consists of m rows $r_1$ to $r_m$ each comprising n display elements or pixels 2, and n columns $c_1$ to $c_n$ with m pixels 2 in each column. Each pixel has an associated active element, in the example a transistor 3. Normally, the gate electrodes of the transistors in any one row are connected in common to the row conductor $r_1, \ldots r_m$ and the source or drain conducting electrodes of the transistors in any one column are connected in common to the column conductor $c_1, \ldots c_n$, the other electrode being connected to a pixel electrode Ep of the associated pixel 2.

An addressing phase of such a display normally includes a write step during which the rows are selected sequentially, and the active elements of each selected row are activated to receive and transfer the analogue voltage level onto the associated pixel capacitance, with a stabilisation time corresponding to the switching time necessary so that all pixels are switched; and an illumination step during which the panel is illuminated, the light modulated by the display and the corresponding image recovered. In a sequential colour mode, these steps are made at least once for each primary colour, within the same video frame.

The write step consists of applying a gate voltage onto the associated row conductor for each row in the panel 1, during a row addressing time $t_l$, (or row time). The effect is to put all transistors 3 of this row into the ON (conducting) state, and to switch voltages applied onto the columns corresponding to the video information to be displayed, onto the pixel electrodes Ep. This addressing is controlled by control circuits called the row driver D-X to select rows, and the column driver D-Y to control grey levels on the pixels. These drivers may be integrated into the display or they may be external. Each row is thus addressed for one row time during each addressing phase, such that all rows in the display panel are scanned. Addressing is normally done in sequence row after row. Other row addressing modes are possible. In particular, the rows in a panel may be distributed into different groups so that several rows can be addressed simultaneously in write. In the case of a sequential colour display, there is one addressing phase per coloured sub-frame in a video frame.

Figure 2:
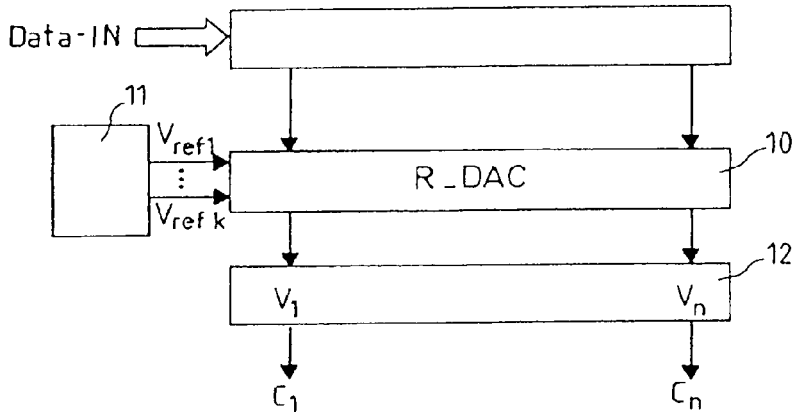
FIG. 2 is a block diagram of a device for control of the columns in the panel according to the state of the art.

The grey levels on the pixels in a selected row are controlled by applying a set of analogue voltage levels $V_1$ to $V_n$, with one for each column $c_1$ to $c_n$, corresponding to video information applied at the input (DataIN), and defined as a function of a grey level determined for the display. In the example shown in FIG. 2, this set of analogue voltage levels $V_1$ to $V_n$ is output by a digital analogue converter 10. According to one known example architecture, this converter is of the R-DAC type, in other words it uses a voltage reference circuit 11 that outputs k analogue reference voltage levels $V_{ref1}$ to $V_{refk}$, and a string of resistances in series that sets up resistive divider bridges with l stages between each reference level $V_{ref1}$ to $V_{refk}$, to output analogue voltage levels $V_1$ to $V_n$. The converter 10 thus sets up a bijection between each digital code received at the input and an analogue voltage level V1 to Vn. The number of grey levels in the panel is equal to $(k-1)\cdot l$ or $(k-1)\cdot l/2$ depending on the chosen addressing mode. For each series of video data in the incoming flow DataIN corresponding to a row on the display, the converter 10 thus outputs a set of n analogue voltage levels $V_1$ to $V_n$ through an amplifier device 12, and these levels are applied to columns $c_1$ to $c_n$. In general, the polarity of voltages $V_1, \ldots V_n$ to be applied to the columns is inverted during each addressing phase; there is thus an alternation of positive and negative frames (or sub-frames). This can result in a zero average voltage on the liquid crystal and prevents marking of the panels.

Figure 3:
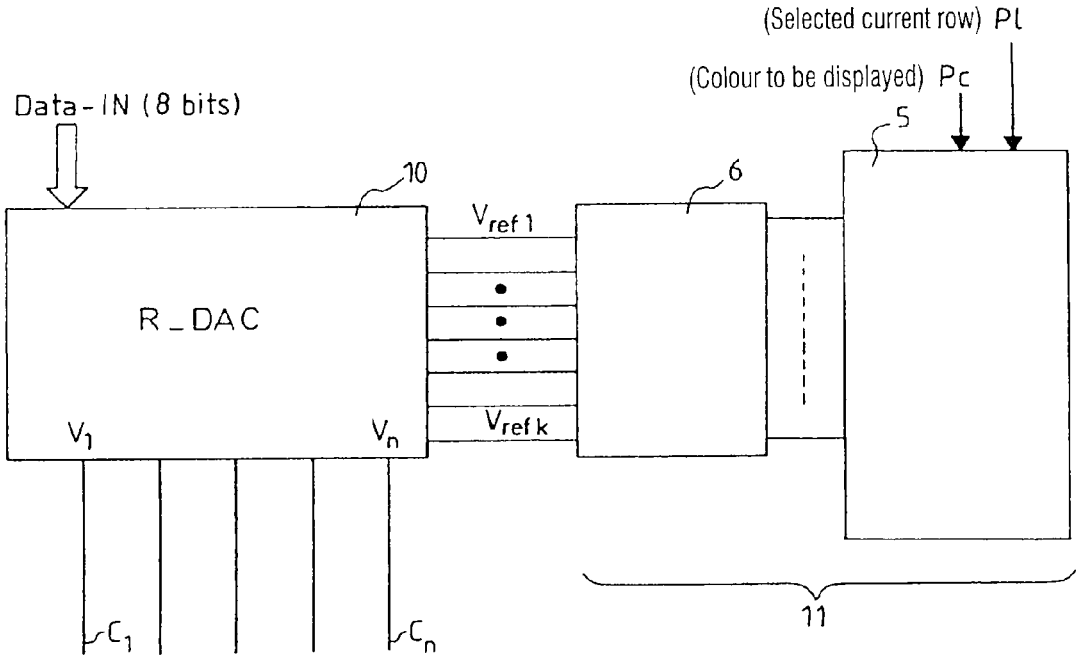
FIG. 3 diagrammatically shows a voltage reference circuit used to vary the grey scale as a function of the colour to be displayed and/or the selected current row.

In the invention and as shown in FIG. 3, the display includes a circuit 11 capable of generating a set of analogue reference voltages $V_{ref1}$, $V_{refk}$ defining a scale of grey levels given as a function of a selected current row and/or a colour to be displayed. The grey scale thus selected outputs a corresponding analogue voltage $V_1, \ldots V_n$ to be applied onto these pixels through their associated column $c_1, \ldots c_n$, for each video information received for the pixels in a selected current row. Therefore the generation circuit 11 can thus generate a plurality of sets of analogue reference voltage values $V_{ref1}, \ldots V_{refk}$, each set coding a different grey scale determined as a function of the position of the row in the panel or the colour concerned. Thus, a grey scale is used at all times optimised as a function of these row position and colour parameters. Pl is a selection parameter corresponding to the position of the row selected in write, and Pc is a parameter corresponding to the current display colour.

In one example embodiment shown in FIG. 3, the generation circuit 11 according to the invention includes a device 5 for memorising sets of digital values, each set coding a grey scale optimised as a function of the position of the selected current row and/or the colour to be displayed. For example, the device 5 may be a RAM type memory. It is associated with a circuit 6 of k digital to analogue converters to output analogue reference values $Vref_1$ to $Vref_k$ corresponding to the set of digital values selected in the circuit 5 and applied to the input of the digital to analogue conversion circuit 6. Circuits 10 and 11 are synchronised so that there is a set of reference values $Vref_1$ to $Vref_k$ at each change of the conditions on the parameters Pc and/or Pl, corresponding to these new conditions.

In a first embodiment of the invention, the selection of an applicable grey scale depends on the position of the current selected row. This embodiment is applicable to any type of liquid crystal display, for example displays that only comprise a single addressing phase per video frame, with illumination in dynamic white light on a panel for which the structure may or may not have coloured filters. In this first embodiment, it is planned to modify the set of reference values $V_{ref1}$ to $V_{refk}$ as a function of the position of the selected row in the current addressing phase. Considering FIG. 3, the memorisation device 5 contains a plurality of sets of digital values as a function of the value of the parameter Pl. The value accepted by the parameter Pl is used as a pointer to a corresponding set of digital values that is then applied to the input to the circuit 6 of digital to analogue converters that output analogue voltages $V_{ref1}$ to $V_{refk}$. Thus, a new set of analogue reference voltages $Vref_1$ to $Vref_k$ may be made to correspond to a change that occurs to the row(s) selected in write. In practice, the value of the parameter Pl may be derived from row addressing signals. If it is planned to make a particular grey scale correspond to each different row in the panel, the parameter Pl may for example be obtained from a digital circuit that detects a transition on the row addressing signals output from the row control circuit D-X (FIG. 1). It may be arranged to have a particular grey scale correspond to several rows in the panel. A circuit for detection of corresponding conditions that can output the value of the parameter Pl will include logical functions capable of detecting the corresponding conditions from row addressing signals. Such a circuit to detect conditions on the addressing signals will not create practical manufacturing problem.

The required number of grey levels is determined particularly as a function of the panel type and its characteristics, the number of rows addressed simultaneously in write, and the required display quality.

Every time that parameter Pl changes, a new corresponding set of analogue reference voltage levels $V_{ref1}, \ldots V_{refk}$ is charged. This set is used for the current write step and for subsequent write steps, until the parameter Pl changes. It then points to a new set of digital values in the device 5, and a new corresponding set of reference analogue voltage levels $V_{ref1}, \ldots V_{refk}$ is obtained. In doing this, the analogue voltage levels $V_1$ to $V_n$ applied onto the columns is modulated as a function of the position of the pixels.

Figure 4:
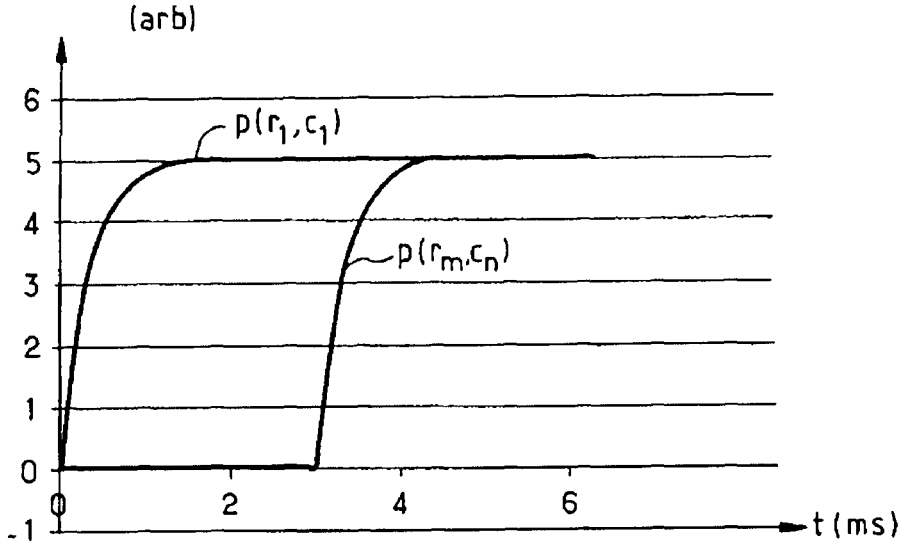
FIG. 4 shows a brightness shading effect as it can be measured using a display according to the state of the art.
Figure 5:
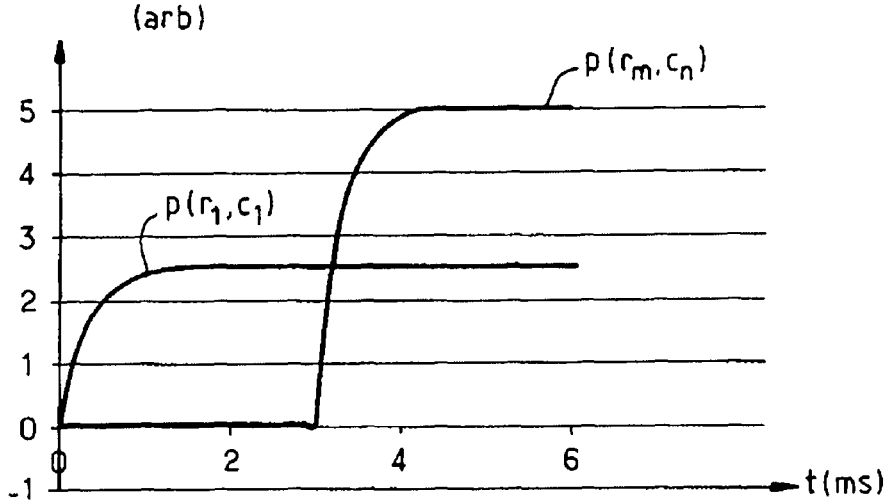
FIG. 5 shows the compensation of this effect obtained according to the invention.

FIGS. 4 and 5 illustrate brightness curves obtained during an addressing phase as a function of the position of the pixels in the panel, the first with a display according to the state of the art with a single grey scale defined for the panel, and the second with a display according to the invention, using a plurality of grey scales as a function of the position of the pixel in the row. FIG. 4 shows a large disparity of brightness between the first pixel $p(r_1, c_1)$, in the first row $r_1$ and the first column $c_1$, and the last pixel $p(r_m, c_n)$, in the last row $r_m$ and the last column $c_n$. In FIG. 5, the area under the curve becomes comparable for the two pixels.

In a second embodiment of the invention, the applicable grey scale depends on the colour to be displayed. It is applicable to a sequential colour display. The value of the selection parameter Pc is defined by the colour of the coloured sub-frame corresponding to the current addressing phase. This colour information may typically be obtained from control signals of the light box. The set of applied reference analogue values $Vref_1$ to $Vref_k$ may then be modified during each colour change, in other words during each new addressing phase. This is equivalent to modulating the analogue voltage levels $V_1$ to $V_n$ applied onto the columns as a function of the colour of the sub-frame. In other words, a grey level scale is provided for each colour. The grey level scale is normally calibrated for each panel so as to integrate a so-called gamma compensation (or S curve) to improve the display performances of the display. According to the invention, the grey scale may thus integrate the gamma compensation optimised for the corresponding colour. In practice, the analogue reference voltage values $Vref_1$ to $Vref_k$ are modified at the beginning of each new addressing phase, as a function of the colour of the corresponding addressing phase.

With reference to FIG. 3, the value of the parameter Pc that corresponds to the illumination colour of the current addressing phase, is used to point to a determined set of numeric values in memory 5, that is then applied to the input of the conversion circuit 6 that outputs the corresponding set of reference analogue voltages $V_{ref1}$ to $V_{refk}$. In practice, the memorisation device 5 memorises three sets of digital values each defining a particular grey scale, one set per primary colour. Each set is determined specifically for the associated primary colour, for the display considered, so as to benefit from an optimum gamma correction curve in each colour.

Obviously, the different parameters for determination of the applicable grey scale can be combined depending on the colour and the row. A set memorised in the device is then selected as a function of a combination of the two pointers Pc and Pl.

The invention that has just been described is applicable to any display for which it is required to improve the brightness or energy consumption at constant brightness. It is equally applicable to displays using an addressing mode in which the m rows of the panel are each selected one after the other, or in which several rows may be selected at the same time. This is possible particularly in a matrix display with sequential display of colours of the active matrix type, in which the rows are distributed into p groups and in which each pixel column comprises p column conductors for write selection of pixels in p rows in parallel, with one row per group. For example, each group may include m/p successive rows of the panel, such that the display is organised into p bands of m/p rows. Either rows selected simultaneously may use the same grey scale, or a different grey scale may be made to correspond to each of these rows selected simultaneously. This does not create any particular manufacturing problem, because when p rows are selected at the same time, there are p column drivers in parallel such that a different set of reference analogue voltages can be applied to each of the p column drivers.

It will be readily seen by one of ordinary skill in the art that the present invention fulfills all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by the definition contained in the appended claims and equivalent thereof.

The invention claimed is:

1. A video system comprising:

a sequential color liquid crystal display with a panel of pixels arranged in rows and columns, the sequential color liquid crystal display is configured to be illuminated by a light box successively in three primary colors;

means for controlling grey levels on each pixel in the panel, each grey level corresponding to a video information received at an input, said means for controlling receiving video information of pixels of a selected row, and applying analog voltages corresponding to said video information onto the pixels of the selected row through their associated column; and wherein a generation circuit applies a different set of reference analog voltage values for each row in the panel, each set of analog reference voltages defining for a corresponding row a given scale of grey levels as a function of a position of a selected current row in the panel and/or a color to be displayed, so that for a same video information received at input, a grey level for a pixel is made variable according to the position of the row currently selected through said corresponding different set of analog voltage references applied, enabling uniform display performance.

2. A video system according to claim 1, further comprising a device that memorizes sets of digital values, each set coding a determined grey scale, and a circuit of digital to analog converters, the circuit of converters receiving a set among the plurality of memorized sets of digital values at the input, selected as a function of the current selected row to be displayed, and outputting a corresponding set of reference analog voltage values.

3. A video system according to claim 1, wherein the generation circuit outputs a specific set of reference analog voltage values for a plurality of rows with determined positions in the panel.

4. A video system according to claim 2, wherein the generation circuit outputs a specific set of reference analog voltage values for a plurality of rows with determined positions in the panel.

5. A video system according to claim 1, wherein the circuit generates the set of analog reference voltages defining a given scale of grey levels as a function of the position of the selected current row in the panel and/or the color to be displayed.

6. A video system according to claim 1, further comprising:

a memory device configured to receive a first parameter corresponding to a position of the row selected in write and/or a second parameter corresponding to a current display color.

7. A video system according to claim 6, wherein a value of the first parameter is derived from row addressing signals.

8. A video system according to claim 5, wherein a value of the second parameter is derived by the color of a colored sub-frame corresponding to a current addressing phase.

9. A video system according to claim 1, wherein the circuit generates the set of analog reference voltages defining a given scale of grey levels as a function of the position of the selected current row in the panel and the color to be displayed.

10. A video system comprising:

a sequential color liquid crystal display with a panel of pixels arranged in rows and columns, the sequential color liquid crystal display is configured to be illuminated by a light box successively in three primary colors;

means for controlling grey levels on each pixel in the panel, each grey level corresponding to a video information received at an input; and a circuit that generates a set of analog reference voltages defining a given scale of grey levels as a function of a position of a selected current row in the panel and/or a color to be displayed, wherein said circuit that generates provide a different set of reference analog voltage values for each row in the panel to generate a uniform display performance on an entire display surface by applying an appropriate analog voltage on each pixel through a column associated with the pixel in a currently selected row as a function of the video information to be displayed, so that for a same video information received a grey level for a pixel is made variable according to the position of the row currently selected, and the given scale of the grey levels is determined based on the position of the selected row.

* * * * *